343-700 MS AU 256 EX

12/13/77 OR 4,063,246

United States Patent [19]

Greiser

[11] 4,063,246

[45] Dec. 13, 1977

[54] COPLANAR STRIPLINE ANTENNA

[75] Inventor: John W. Greiser, Marina del Rey, Calif.

[73] Assignee: Transco Products, Inc., Venice, Calif.

[21] Appl. No.: 691,239

[22] Filed: June 1, 1976

[51] Int. Cl.[2] ..... H01Q 1/48; H01P 3/08

[52] U.S. Cl. ..... 343/700 MS; 343/769; 343/846

[58] Field of Search ..... 343/700 MS, 769, 854, 343/708, 846, 829

[56] References Cited

U.S. PATENT DOCUMENTS

| | | | |
|---|---|---|---|
| 3,086,204 | 4/1963 | Alford | 343/769 |
| 3,665,480 | 5/1972 | Fassett | 343/854 |
| 3,803,623 | 4/1974 | Charlot Jr. | 343/700 MS |

*Primary Examiner*—Alfred E. Smith
*Assistant Examiner*—David K. Moore
*Attorney, Agent, or Firm*—Charles H. Schwartz

[57] ABSTRACT

A coplanar stripline antenna including a layer of dielectric material supporting a lower ground plane of conductive material on one side of the layer of dielectric material, a patch of conductive material on the other side of the layer of dielectric material, and an upper ground plane of conductive material on the other side of the layer of dielectric material and with the upper ground plane substantially surrounding and spaced from the patch of conductive material.

Electrical signals are fed to the antenna between the patch of conductive material and the upper ground plane. A number of patches of conductive material may each be surrounded by the upper ground plane to form an antenna array and with the patches interconnected by coplanar stripline fed at a point equidistant from each patch.

20 Claims, 17 Drawing Figures

COPLANAR STRIPLINE ANTENNA

The present invention is directed to a coplanar stripline atenna that is formed from printed circuit board construction techniques. The structure of the antenna is very thin and because of this thinness the antenna may be conformal so as to follow the shape of the surface to which the antenna is mounted. For example, the antenna may be mounted on the outside surface of an airplane and may conform to the outside surface of the airplane. Because the antenna is very thin and conforms to the outside surface, the antenna does not present any significant resistance to air and does not significantly disturb the aerodynamics of the airplane.

There are basically four different types of electrically thin microwave transmission lines that can be formed from printed circuit board construction. These are generally stripline, microstrip line, slot line and coplanar stripline. Stripline or triplate line is the earliest and probably most widely used configuration and includes an inner conducting strip between two outer ground planes. Microstrip line is a single conducting strip spaced from a ground plane. Slot line is formed by a slot in the first plane spaced from a second ground plane. Finally, coplanar stripline is a conducting strip spaced from a surrounding ground plane and with the strip and surrounding ground plane located in the same plane. Coplanar stripline may also use a second ground plane spaced from the first ground plane.

In the prior art these different forms of microwave transmission lines have been modified in structure so as to produce conformal antennas of different configurations. For example, stripline has been used to produce a slot antenna which when properly designed and constructed has provided desirable electrical performance. Microstrip line has also been used to produce antennas but only at a reduction in electrical performance. Slot line antennas have not been extensively studied but this type of structure has considerable electrical problems.

Coplanar stripline has not been used extensively and is not normally used to provide an antenna structure. There has been one proposal for a log-periodic coplanar stripline antenna, but this antenna structure did not include a lower ground plane as part of the antenna structure.

The present invention is a coplanar stripline antenna which includes a lower ground plane closely spaced from the upper ground plane and which has several advantages over the conventional stripline and microstrip antennas of the prior art. Specifically, the coplanar stripline antenna of the present invention has low losses, low fringing, low mutual coupling, high gain for a given size, good variation in achievable impedance levels, and low likelihood of launching trapped waves in the dielectric slab. In addition to the above, the coplanar stripline antenna of the present invention is mechanically simpler than stripline antennas and is no more mechanically complicated than microstrip or slot line antennas.

The coplanar stripline antenna of the present invention includes a conducting strip spaced from but in the same plane as an upper ground plane. Spaced from the conducting strip and the upper ground plane is a second lower ground plane which is in the fringing field between the conducting strip and the upper ground plane. The coplanar stripline antenna of the present invention may be excited with electrical signals between the conducting strip and the upper ground plane. This type of excitation results in better confinement of the E-field lines which in turn results in less fringing and also reduces the E-field intensity in the dielectric medium.

The coplanar stripline antenna of the present invention may also be formed as an array of antenna elements and with the individual antenna elements fed with electrical signals by coplanar striplines. The feed point may be located at a position equidistant from each separate antenna element and with the signals coupled through a coaxial connector located on the bottom ground plane and with the signals fed to the conducting strip. The lower and upper ground planes are coupled to each other and to the coaxial connector.

The present invention, therefore provides for the realization of very thin conformal antennas which have mechanical and electrical advantages over conformal antennas presently in use. A clearer understanding of the invention will be had with reference to the following description and drawings wherein.

Figure 1:
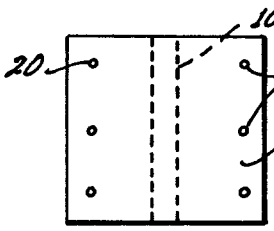
FIG. 1 PRIOR ART
FIGS. 1 and 1(*a*) are a top view and a cross-sectional view of a stripline transmission line of the prior art.

FIGS. 1 and 1(*a*) illustrate stripline or triplate line which is the earliest and probably the most widely used configuration for printed circuit type transmission line. A very large number of microwave components are currently produced in the stripline form. The advantages of stripline include its excellent containment of fields, its wide range of impedance levels, and its predictable electrical characteristics. Stripline is normally energized between the center conducting strip and the outer two ground planes. Since both ground planes are equally important in defining the transmission path, the two ground planes must be kept at the same electrical potential for proper performance. Because of this, shorting pins or wires are normally installed between the ground planes but this use of shorting pins increases the cost and also reduces the reliability since the integrity of the shorting pins is important.

The stripline transmission line of FIGS. 1 and 1(*a*) includes a center conducting strip 10 equidistant between two ground planes 12 and 14 and with the layers of dielectric material 16 and 18 insulating the central conductor 10 from the ground planes. Shorting pins 20 are shown extending between the ground planes so as to ensure that the ground planes are at the same electrical potential.

Figure 2:
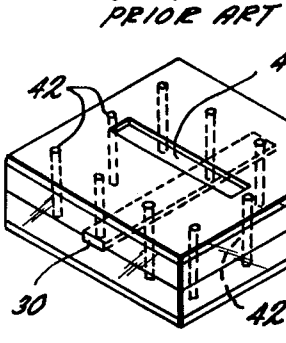
FIG. 2 PRIOR ART
FIG. 2 is a perspective view of a stripline antenna structure of the prior art.

FIG. 2 is a perspective view of a slot antenna formed from stripline. Specifically, the stripline includes a center conducting strip 30 and with ground planes 32 and 34 spaced from the center conducting strip by layers of dielectric material 36 and 38. A slot 40 is formed in one of the ground planes so that the structure of FIG. 2 forms a slot antenna.

In order to ensure proper performance of the antenna of FIG. 2, a ring of shorting pins 42 must be used around the slot so as to define a cavity backing. The resulting cavity is a high Q structure and is quite sensitive to spacing between the ground planes and to the electrical integrity of the shorting pins 42. For example, over wide temperature ranges, stripline antennas are well known for erratic behavior unless careful mechanical design has gone into the structure.

Even though stripline antennas have many desirable electrical properties, they tend to be more costly to manufacture than single board structures because stripline antennas require a greater number of fabrication operations. Stripline antennas are also thicker in cross-section than single board structures. The stripline antennas are difficult to build and since, in order to obtain proper results, the registration between the two boards must be very accurate. Also, as indicated above, it is necessary to use shorting pins and this is an additional procedure which adds to the cost of the antenna. It would be desirable to provide for an antenna structure which has or even exceeds the desirable electrical properties of stripline antennas but with the elimination of the mechanical problems of stripline antennas described above.

Figure 3:
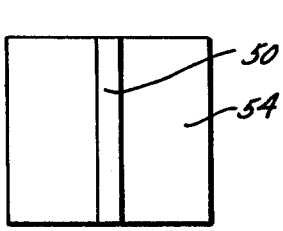
FIG. 3 PRIOR ART
FIGS. 3 and 3(*a*) are a top view and a cross-sectional view of a microstrip transmission line of the prior art.

FIGS. 3 and 3(*a*) are a topview and a cross-sectional view of a microstrip line which is second in use to stripline for thin transmission line structures. The main advantage of microstrip line is simplicity since it consists of a single conducting strip 50 spaced from a single ground plane 52 by a layer of dielectric material 54.

Figure 4:
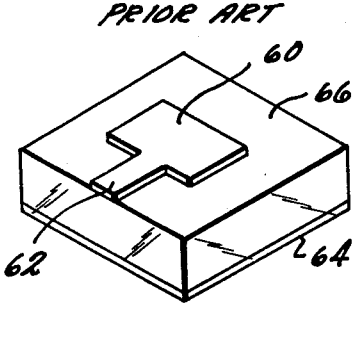
FIG. 4 PRIOR ART
FIG. 4 is a perspective view of a microstrip antenna structure of the prior art.

FIG. 4 is a perspective view of a microstrip line antenna structure which consists of a rectangular area or patch 60 which extends from a center conducting strip 62. The patch 60 is spaced from a ground plane 64 by a layer of dielectric 66. The problems associated with all components formed with microstrip structure are related to the fact that the microstrip line structure is a semi-open system. Consequently, feed line radiation and cross-coupling or mutual interaction occurs between nearby transmission lines and antenna patches. Even through microstrip antennas have considerable problems, these antennas have found applications in systems where moderate electrical performance can be tolerated. As indicted above, these problems which relate to cross-polarization and coupling between adjacent elements makes for a less efficient and less desirable antenna than stripline antennas.

Figure 5:
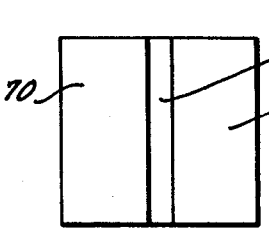
FIG. 5 PRIOR ART
FIGS. 5 and 5(*a*) are a top view and a cross-sectional view of a slot line transmission line of the prior art.

FIGS. 5 and 5(*a*) are a top view and a cross-sectional view of a slot line transmission line which includes a pair of upper conducting planes 70 and 72 spaced by a slot 74. The planes 70 and 72 are supported on a layer of dielectric material 76. The specific structure shown in FIGS. 5 and 5(*a*) includes a lower ground plane 78, but normally a lower ground plane is not present in a slot line transmisin line. In order to be consistent with the previous descriptions, such a lower ground plane is shown.

The slot line of FIG. 5 is generally energized by connecting a coaxial line at right angles across the gap or slot 74 so as to produce balanced excitation. No current is fed to the lower ground plane 78. Although the slot line shown in FIGS. 5 and 5(*a*) and the microstrip line shown in FIGS. 3 and 3(*a*) appear to be duals, microstrip and slot lines are not duals because they are not energized in a dual manner.

Slot line stuctures have several problems when used in antenna systems. The slot line will radiate a substantial power of its length approaches one-half wavelength. In addition, slot lines do not propagate a TEM mode. Thus, the field in the slot is elliptically polarized and this complicates the design of power dividers and raises the level of cross-polarized energy producted by a slot line antenna. An additional problem with slot line is difficulty in providing an effective transition from slot line to a 50 ohm coaxial cable on the lower ground plane. The connecting of a coaxial line at right angles across the gap as indicated above would be very difficult ot realize without projecting above the surface of the upper ground plane. For these reasons, the slot line structure would not be recommended for conformal antenna applications.

Figure 6:
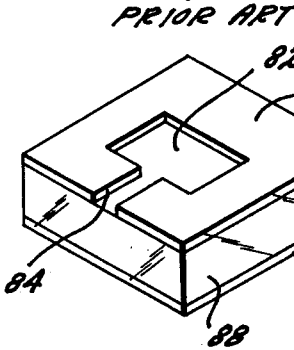
FIG. 6 PRIOR ART
FIG. 6 is a perspective view of a slot line antenna structure of the prior art.

As shown in FIG. 6, a slot line antenna would include an upper ground plane 80 supported on a layer of dielectric material 88 and with a rectangular antenna slot 82. The antenna slot is fed by a slot line 84. A lower ground plane 86 is included but normally, as indicated above, slot line transmission line does not include a lower ground plane.

Figure 7:
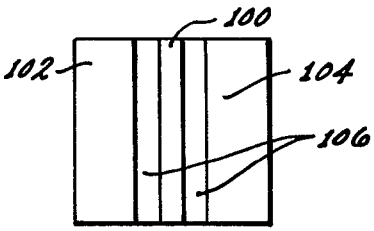
FIGS. 7 and 7(*a*) are a top view and a cross-sectional view of coplanar stripline transmission line including a lower ground plane.
Figure 1A:
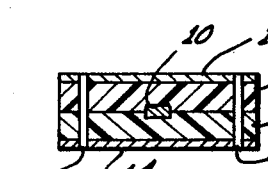
FIG. 1a PRIOR ART
Figure 3A:
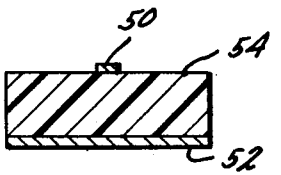
FIG. 3a PRIOR ART
Figure 5A:
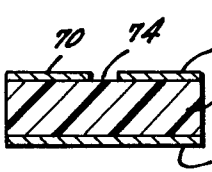
FIG. 5a PRIOR ART
Figure 7A:
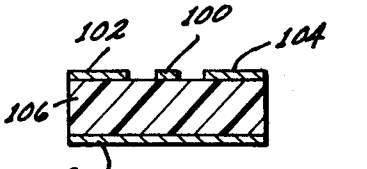

FIGS. 7 and 7(*a*) are a top view and a cross-sectional view of a coplanar strip line which includes a center conducting strip 100 and with upper ground planes 102 and 104 spaced from the center conducting strip 100. The upper ground planes and conducting strip are supported by a layer of dielectric material 106. The structure shown in FIGS. 7 and 7(*a*) includes a lower ground plane 108. Normally, in coplanar stripline no lower ground plane is used. If there is such a lower ground plane, it is spaced very far from the center conducting strip 100 and the upper ground plane members 102 and 104 so as not to form a substantial part of the transmission line electrical system.

In the antenna of the present invention, the lower ground plane is spaced close to the center conducting strip 100 and the upper ground planes 102 and 104 so as to be within the fringing field and form a part of the electrical system. Specifically, the use of the lower ground plane helps to create a unidirectional antenna. If the lower ground plane were not present, the antenna would be bidirectional and this is not desirable for a conformal antenna since such antennas should be unidirectional since they are often used on the outside surface of an airplane.

In addition, it is desirable to include the lower ground plane as opposed to using the outside surface of the airplane itself as the ground plane, since the outside surface of the airplane would not be at the same controlled distance from the other elements in the antenna, and could lead to varying electrical characteristics. The use of the ground plane close to the other elements so as to form a unidirectional antenna also provides that the electrical characteristics of the antenna of the present invention are reproducible.

Figure 8:
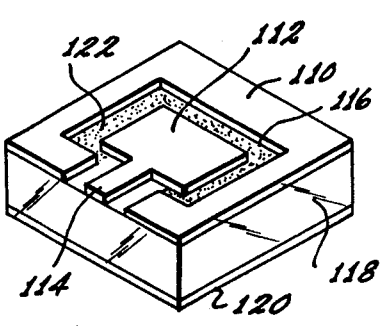
FIG. 8 is a perspective view of a coplanar stripline antenna structure in accordance with the teachings of the present invention.

FIG. 8 is a perspective view of a coplanar stripline antenna in accordance with the teachings of the present invention. In FIG. 8 an upper ground plane 110 substantially surrounds but is spaced by a slot 116 from a rectangular conducting patch 112 to form the antenna. A center conducting strip 114, in combination with the surrounding portions of the upper ground plane 110, form a coplanar stripline transmission line which is used to feed electrical signals to the antenna 112. The electrical path of the slot 116 extending around the patch 112 is approximately one wavelength of the resonant frequency radiated by the antenna.

The various conducting elements including the upper ground plane 110, the antenna patch 112 and the center conductor strip 114 are all supported on a layer of dielectric material 118. In addition, a lower ground plane 120 is also supported by the layer of dielectric material 118. As indicated above, the lower ground plane 120 is close to the upper ground plane so that it is substantially within the fringing field between the antenna patch 112 and the outer surrounding upper ground plane 110. In this way, the antenna produces a unidirectional radiation pattern which is desirable for the conformal antenna structure of the present invention. In additiion, the lower ground plane 120 by being close to the upper ground plane and forming part of the electrical system provides for a uniform structure which is reproducible. Also, the skin of the airplane, if the antenna is attached to an airplane, does not affect the characteristics of the antenna since the lower ground plane 120 forms the lower surface with which the remaining portions of the antenna structure coact.

FIG. 8 also shows the use of a dielectric material such as a paint 122 which may be used in the slot 116 so as to tune the resonant frequency of the antenna. For example, this dielectric paint may contain titanium dioxide. The dielectric paint will tune the resonant frequency of the antenna since the E-fields are concentrated in the gap 116 and any dielectric material will interact with the E-fields to affect the resonant frequency of the antenna.

As indicated above, the log-periodic antenna structure had been previously realized in coplanar stripline. However, this antenna structure was considerably different and did not include the lower ground plane. The coplanar stripline antenna of the present invention has numerous advantages over the conventional stripline antenna shown in FIG. 3 and the microstrip and slot line antennas shown in FIGS. 4 and 6. The coplanar stripline antenna of the present invention has low losses, low fringing, low mutual coupling, high gain for a given size, good variation in achievable impedance levels, low likelihood of launching trapped waves in the dielectric member and is mechanically simpler than the stripline antenna.

Coplanar stripline is normally excited between the narrow center conducting strip and the upper ground planes which upper ground planes are closely spaced to the center conducting strip. For example, the coplanar stripline antenna shown in FIG. 8 would be excited between the center conducting strip 114 and the surrounding portions of the upper ground plane 110. This results in a better concentration of the E-field lines with less fringing and also reduces the E-field intensity in the layer of dielectric material 118.

Figure 9:
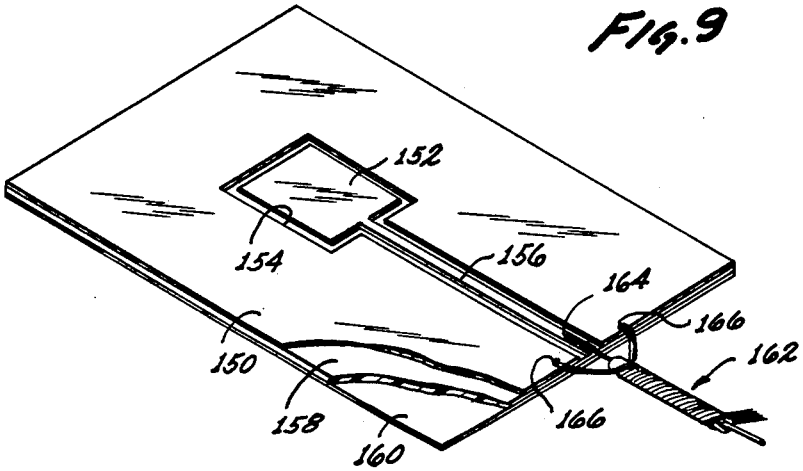
FIG. 9 is a perspective view of a first embodiment of a coplanar stripline antenna of the present invention showing a single antenna element fed by a coaxial line.

FIG. 9 illustrates a first embodiment of a coplanar stripline antenna in accordance with the present invention. In FIG. 9, an upper ground plane 150, substantially surrounds and is spaced from an antenna element 152 by a gap 154. The gap 154 between the antenna element 152 and the upper ground plane 150 has a length of approximately one wavelength for the resonant frequency of the antenna. A center conducting strip 156 which is also spaced from the ground plane 150 is used to feed the antenna element 152. The elements 150, 152, and 154 are all supported on a layer of dielectric material 158 and with a closely spaced ground plane 160 forming the lower ground plane. A coaxial cable 162 has its inner conductor 164 connected to the center conducting strip 156. The outer portion of the coaxial cable is connected to the upper ground plane 150 at positions 166.

Figure 10:
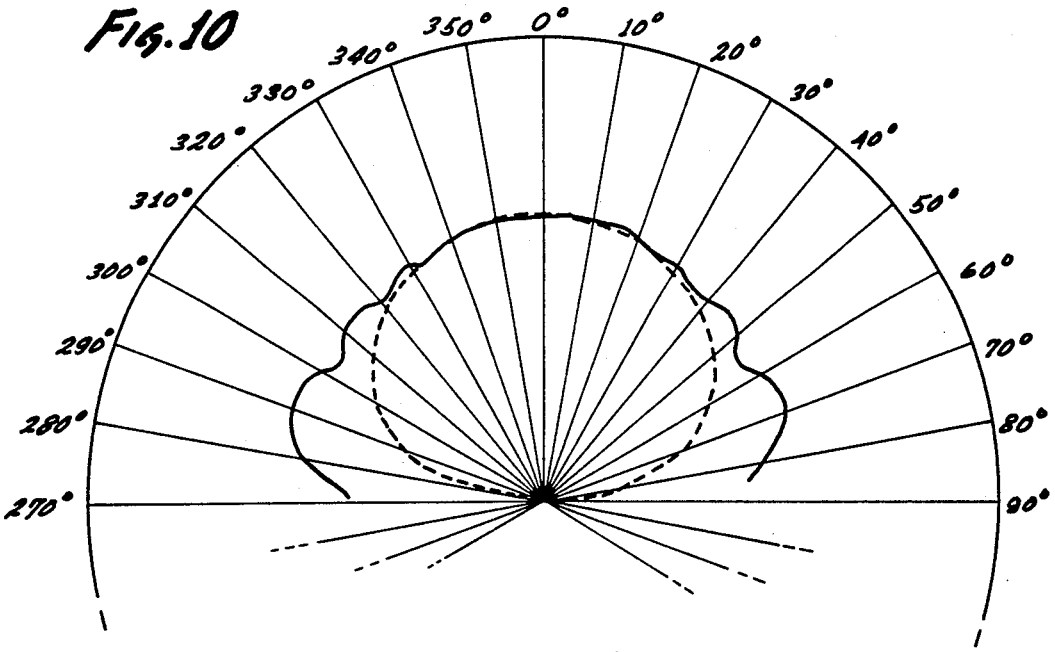
FIG. 10 illustrates a radiation pattern produced by the coplanar stripline antenna of FIG. 9.

The antenna of FIG. 9 was designed to radiate a single lobe slot type pattern and FIG. 10 illustrates the radiation pattern from the antenna of FIG. 9 at the radiation frequency. The pattern cut is through the feed line 156 and normal to the plane of the slot 165 which cut would be an E-plane cut and with the polarization of the transmitting source parallel to the feed line 156. As shown in FIG. 10, the E-plane pattern is shown by a solid line and the H-plane pattern is shown by a dotted line. The E-plane pattern is broader than the H-plane pattern which corresponds to the usual behavior of slot antennas. Cross-polarization is generally more than 20 dB down and the antenna is well matched to the impedance of the coaxial line 162 at the designed frequency.

Figure 11:
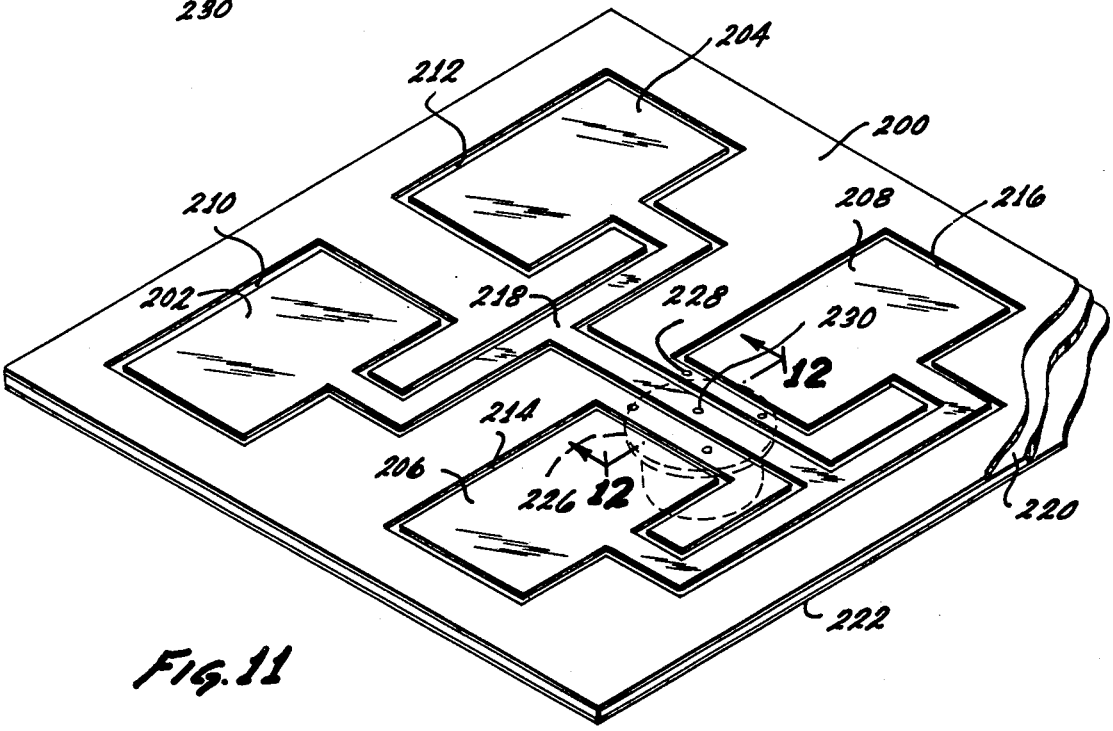
FIG. 11 is a perspective view of a coplanar stripline antenna of the present invention including an array of four elements each fed by coplanar stripline.

FIG. 11 illustrates a coplanar stripline antenna array of four antenna elements which provides excellent electrical performance characteristics. The antenna array of FIG. 11 includes an upper ground plane 200 substantially surrounding four antenna elements 202, 204, 206, and 208. Each antenna element is spaced from the upper ground plane 200 by gaps 210 through 216. A coplanar stripline conducting strip 218 is used to feed all of the antenna elements and the upper ground plane, the antenna elements, and the coplanar stripline feed member all supported on a layer of dielectric material 220. A lower ground plane 222 is also supported on the layer of dielectric material 220. The gaps 210 through 216 may also include additional dielectric material such as a paint including dielectric material as shown in FIG. 9 so as to tune the resonant frequency of the antenna. As indicated above with reference to FIG. 9, this dielectric material may be paint containing titanium dioxide.

Figure 12:
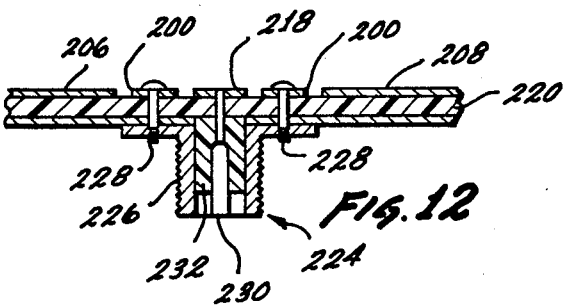
FIG. 12 is a cross-sectional view of the antenna of FIG. 11 taken along lines 12—12 showing the coaxial cable connector coupled to the lower ground plane to feed the antenna array.

In order to properly feed the antenna array of FIG. 11, a coaxial connector may be supported on the lower ground plane. Specifically, as shown in FIG. 12, a coaxial connector 224 includes an outer connecting shell portion 226 which is positioned against the lower ground plane 222, and with screws 228 extending from the upper ground plane 200 to lock the outer shell of the connector 224 in position. The screws 228 connect the outer shell portion 226 of the connector 224 to the upper ground plane 200. An inner conductor 230 of the connector 224 extends through the layer of dielectric material 220 and is coupled to the feed line 218. A dielectric member 232 insulates the inner conductor 230 from the outer shell portion 226.

As shown in FIG. 11, the feed point between the conductor 230 and the coplanar stripline 218 is at a point equidistant from all four antenna elements 202 through 208. This ensures an equal radiation from the various antenna elements in the array.

Figure 13:
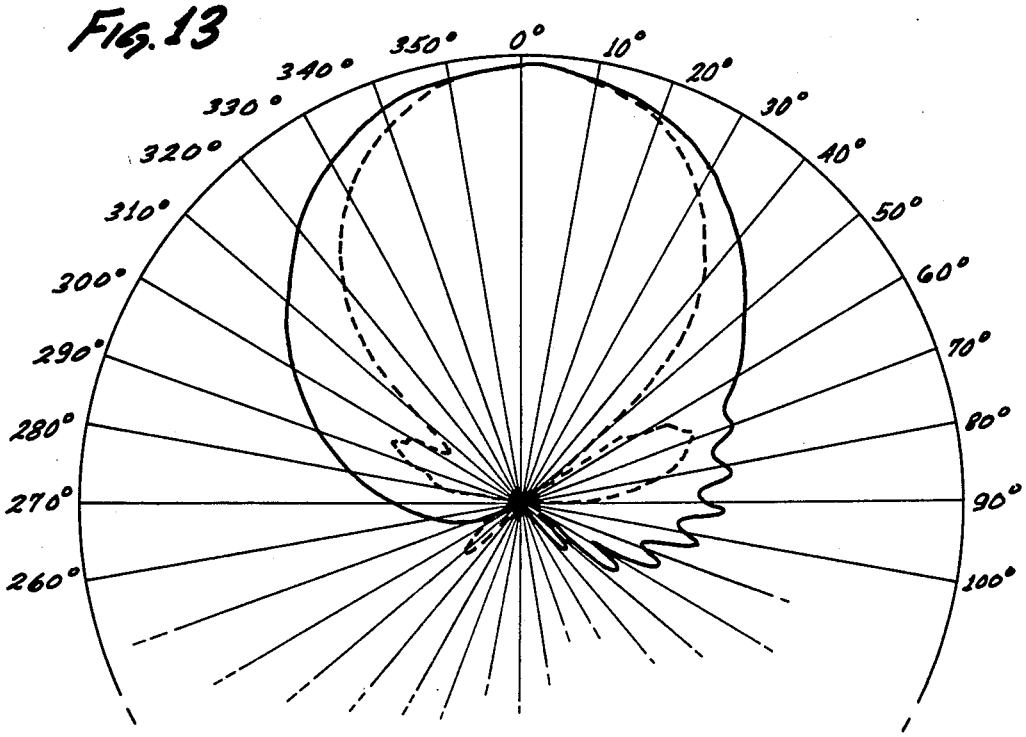
FIG. 13 illustrates a radiation pattern produced by the antenna of FIG. 11.

FIG. 13 illustrates a radiation pattern which is measured in a similar manner to the radiation pattern of FIG. 10. The E-plane pattern is shown by the solid line and the H-plane pattern is shown by the dotted line and the pattern cut is similar to that described above with reference to FIG. 10. As can be seen in FIG. 13, the E-plane pattern is broader than the H-plane pattern which again is the normal behavior for this type of antenna. The gain of the antenna of FIG. 11 is considerably greater than the gain of the antenna of FIG. 9, which is to be expected, since the antenna of FIG. 11 includes an array of four antenna elements as opposed to the single antenna element of the antenna of FIG. 9.

The conformal coplanar antenna of the present invention provides a significant improvement over conventional microstrip and stripline antennas. It is of a single board construction and does not require the additional shorting pins of the stripline antenna structure. The antenna of the present invention has higher efficiency, higher gain and less fringing than the microstrip antennas. The antenna of the present invention thereby provides for a superior antenna for applications requriring very thin conformal antennas such as those used on airplanes.

It is to be appreciated that although the invention has been described with reference to particular embodiments, other adaptations and modifications may be made and the invention is only to be limited by the appended claims.

I claim:

1. A coplanar stripline antenna, including
a continuous layer of dielectric material,
a lower ground plane of conductive material supported on one side of the layer of dielectric material,
a patch of conductive material supported on the other side of the layer of dielectric material,
an upper ground plane of conductive material supported on the other side of the layer of dielectric material and with the upper ground plane substantially surrounding and spaced from the patch of conductive material, and
means for feeding electrical signals to the antenna between the patch of conductive material and the upper ground plane and including strip conducter connected to an edge portion of the patch in the plane thereof.

2. The coplanar stripline antenna of claim 1 wherein said strip conductor is supported on the other side of the layer of dielectric material and extending through and spaced from the upper ground plane and connected to the patch of conductive material.

3. The coplanar stripline antenna of claim 1 wherein the means for feeding the electrical signals to the antenna includes an electrical connector having an outer shell mounted on the lower ground plane and an inner conductor insulated from and extending through the outer shell, the lower ground plane and the dielectric layer and coupled to the patch of conductive material.

4. The coplanar stripline antenna of claim 3 wherein said strip conductor is supported on the other side of the layer of dielectric material extending through and spaced from the upper ground plane and with the strip conductor connected to the inner conductor and the patch of conductive material.

5. The coplanar stripline antenna of claim 1 wherein the lower ground plane is within the fringing field, between the patch of conductive material and the upper ground plane to provide an unidirectional antenna pattern.

6. The coplanar stripline antenna of claim 1 wherein the length of the perimeter of the patch of conductive material is approximately equal to one wave length for the resonant frequency of the antenna.

7. The coplanar stripline antenna of claim 1 additionally including additional dielectric material within the space between the patch of conductive material and the upper ground plane for tuning the frequency of resonance of the antenna.

8. The coplanar stripline antenna of claim 1 additionally including an array of individual patches of conductive material each substantially surrounded by and spaced from the upper ground plane and with the individual patches interconnected and with the means for feeding electrical signals coupled to all the individual patches.

9. The coplanar stripline antenna of claim 8 wherein the individual patches are interconnected by the strip conductor supported on the other side of the layer of dielectric material extending through and spaced from the upper ground plane.

10. The coplanar stripline antenna of claim 9 wherein the means for feeding the electrical signals is coupled to the strip conductor at a point equidistant from the array of patches of conductive material.

11. A coplanar stripline antenna, including
a lower layer of conductive material,
an upper layer of conductive material,
a continuous layer of dielectric material intermediate the lower and upper layers of conductive material,
the upper layer of condutive material including a first central portion and a second surrounding portion and with the second surrounding portion spaced from and substantially surrounding the first portion, and
means for feeing electrical signals between the first and second portions of the upper layer of conductive material and including a strip conducter connected to an edge portion of the patch in the plane therof.

12. The coplanar stripline antenna of claim 11 wherein the means for feeding the electrical signals to the antenna includes said strip conductor of the upper conductive layer extending through and spaced from the second portion and connected to the first portion.

13. The coplanar stripline antenna of claim 11 wherein the means for feeding the electrical signal to the antenna includes an electrical connector having an outer shell mounted on the lower layer and an inner conductor insulated from and extending through the outer shell, through the lower layer of conductive material and through the dielectric layer and coupled to the first portion of the upper layer of conductive material.

14. The coplanar stripline antenna of claim 13 wherein the inner conductor is coupled to the first portion by said strip conductor of the upper conductive layer extendingthrough and spaced from the second portion and with the strip conductor portion connected to the inner conductor and the first portion.

15. The coplanar stripline antenna of claim 11 wherein the lower layer of conductive material is within the fringing field between the first and second portions of the upper layer of conductive material to provide an unidirectional antenna pattern.

16. The coplanar stripline antenna of claim 11 wherein the length of the perimeter of the first central portion of the upper layer of conductive material is approximately equal to one wave length for the resonant frequency of the antenna.

17. The coplanar stripline antenna of claim 11 additionally including additional dielectric material within the space between the first and second portions of the upper layer of conductive material for tuning the frequency of resonance of the antenna.

18. The coplanar stripline antenna of claim 11 additionally including an array of individual first central portions each substantially surrounded by and spaced from the second portion of the upper layer of conductive material and with the individual first portions interconnected and with the means for feeding electrical signals coupled to all the individual first portions.

19. The coplanar stripline antenna of claim 18 wherein the individual first portions are interconnected by said strip conductor of the upper layer of conductive material extending though and spaced from the second portion.

20. The coplanar stripline antenna of claim 19 wherein the means for feeding the electrical signals is coupled to the strip conductor portion at a point equidistant from the array of first portions of the upper layer of conductive material.

* * * * *